US011705257B2

(12) United States Patent
Luo et al.

(10) Patent No.: US 11,705,257 B2
(45) Date of Patent: Jul. 18, 2023

(54) R-T-B SINTERED MAGNET AND PREPARATION METHOD THEREOF

(71) Applicants: GRIREM ADVANCED MATERIALS CO., LTD., Beijing (CN); Rare Earth Functional Materials (Xiong 'an) Innovation Center Co., Ltd, Hebei (CN); Grirem (Rongcheng) Co., Ltd., Shandong (CN)

(72) Inventors: Yang Luo, Beijing (CN); Dunbo Yu, Beijing (CN); Wei Zhu, Beijing (CN); Xinyuan Bai, Beijing (CN); Xiao Lin, Beijing (CN); Shengjie Zhu, Beijing (CN); Zilong Wang, Beijing (CN); Haijun Peng, Beijing (CN)

(73) Assignees: GRIREM ADVANCED MATERIALS CO., LTD., Beijing (CN); Rare Earth Functional Materials (Xiong'an) Innovation Center Co., Ltd., Baoding (CN); Griceon (Rongcheng) Co., Ltd., Weibai (CN)

( * ) Notice: Subject to any disclaimer, the term of this patent is extended or adjusted under 35 U.S.C. 154(b) by 70 days.

(21) Appl. No.: 17/244,880

(22) Filed: Apr. 29, 2021

(65) Prior Publication Data

US 2021/0343459 A1 Nov. 4, 2021

(30) Foreign Application Priority Data

Apr. 30, 2020 (CN) ..... 202010366346.9

(51) Int. Cl.
*H01F 1/057* (2006.01)
*H01F 41/02* (2006.01)
(Continued)

(52) U.S. Cl.
CPC ..... *H01F 1/22* (2013.01); *C22C 38/005* (2013.01); *C22C 38/06* (2013.01); *C22C 38/10* (2013.01);
(Continued)

(58) Field of Classification Search
None
See application file for complete search history.

(56) References Cited

U.S. PATENT DOCUMENTS

2015/0170810 A1* 6/2015 Miwa ..... C22C 38/001 75/246

FOREIGN PATENT DOCUMENTS

CN 110323053 A * 10/2019 ..... C22C 33/0278

OTHER PUBLICATIONS

Machine translation of CN110323053A. (Year: 2019).*

* cited by examiner

*Primary Examiner* — Xiaowei Su
(74) *Attorney, Agent, or Firm* — Dragon Sun Law Firm, PC; Nathaniel Perkins

(57) ABSTRACT

The present invention relates to an R-T-B sintered magnet and a preparation method thereof. The sintered magnet includes a grain boundary region T1, a shell layer region T2 and an $R_2Fe_{14}B$ grain region T3; at 10 μm to 60 μm from a surface of the sintered magnet toward a center thereof, an area ratio of the shell layer region T2 to the $R_2Fe_{14}B$ grain region T3 is 0.1 to 0.3, and a thickness of the shell layer region T2 is 0.5 μm to 1.2 μm; and an average coating percent of the shell layer region T2 on the $R_2Fe_{14}B$ grain region T3 is 80% or more. In the present invention, by optimizing a preparation process and a microstructure of a traditional rare earth permanent magnet, diffusion efficiency of heavy rare earth in the magnet is improved, such that
(Continued)

coercivity of the magnet is greatly improved, and manufacturing cost is reduced.

11 Claims, 3 Drawing Sheets

(51) Int. Cl.

| | |
|---|---|
| ***B22F 3/24*** | (2006.01) |
| ***H01F 1/22*** | (2006.01) |
| ***H01F 7/02*** | (2006.01) |
| ***C22C 38/00*** | (2006.01) |
| ***C22C 38/14*** | (2006.01) |
| ***C22C 38/06*** | (2006.01) |
| ***C22C 38/16*** | (2006.01) |
| ***C22C 38/10*** | (2006.01) |

(52) U.S. Cl.
CPC ..... *C22C 38/14* (2013.01); *C22C 38/16* (2013.01); *H01F 7/02* (2013.01)

R-T-B SINTERED MAGNET AND PREPARATION METHOD THEREOF

CROSS REFERENCE TO RELATED APPLICATION

The present application is filed based on and claims priority from the Chinese Patent Application 202010366346.9 filed Apr. 30, 2020, the content of which is incorporated herein in the entirety by reference.

TECHNICAL FIELD

The present invention relates to the technical field of rare earth permanent magnet materials, in particular to an R-T-B sintered magnet and a preparation method thereof.

BACKGROUND

A sintered neodymium-iron-boron (Nd—Fe—B) permanent magnet is widely applied to new energy vehicles and other fields on its excellent comprehensive magnetic property. With the continuous progress of manufacturing technology and the improvement of people's awareness of environmental protection, the magnet has attracted much attention from the market in three fields of energy conservation and environmental protection, new energy, and new energy vehicles, and has become a key material to realize the development plan of "Made in China 2025". Its consumption is growing rapidly by 10-20% every year, showing a good application prospect.

For the magnet, coercivity is an important index for evaluating a magnetic property of the Nd—Fe—B permanent magnet material. Heavy rare earth elements Dy and Tb, as important elements for improving the coercivity, may effectively increase anisotropy constants of a 2:14:1 phase magnetocrystalline, but their prices are higher. Thus, the coercivity is generally increased by deposition and diffusion of the heavy rare earth elements Dy and Tb on the surface of the magnet to reduce a manufacturing cost thereof. However, a concentration of the heavy rare earth element decreases greatly from a surface of the magnet toward the inside of the magnet and a diffusion depth is relatively low, resulting in limited property improvement.

SUMMARY

In order to improve coercivity of a magnet and realize replacement of a heavy rare earth metal, the present invention provides an R-T-B sintered magnet and a preparation method thereof. By optimizing a preparation process and a microstructure of the traditional rare earth permanent magnet, diffusion efficiency of heavy rare earth in the magnet is improved, such that the coercivity of the magnet is greatly improved, and manufacturing cost is reduced.

To achieve the above objectives, the present invention provides an R-T-B sintered magnet. The R-T-B sintered magnet includes a grain boundary region T1, a shell layer region T2 and an $R_2Fe_{14}B$ grain region T3, wherein at 10 μm to 60 μm from a surface of the sintered magnet toward a center thereof, an area ratio of the shell layer region T2 to the $R_2Fe_{14}B$ grain region T3 is 0.1 to 0.3, and a thickness of the shell layer region T2 is 0.5 μm to 1.2 μm; and an average coating percent of the shell layer region T2 on the $R_2Fe_{14}B$ grain region T3 is 80% or more.

Further, R contains light rare earth LRE and heavy rare earth HRE, and a content proportion of the HRE is 0.05 wt. % to 1.5 wt. %; and T contains Al, and a proportion of Al is 0.22 wt. % to 0.35 wt. %.

Further, T contains M, M is at least one of Ga, Cu and Zn, and a mass ratio of M/Al is 2 to 3.

Further, the HRE contains Tb and Dy, a content proportion of R is 29 wt. % to 33 wt. %, and a content proportion of the HRE is 0.05 wt. % to 1.5 wt. %; and a content proportion of B is 0.82 wt. % to 0.95 wt. %.

Further, a mass ratio of (HRE+M+Al)/(LRE+T) in the shell layer region T2 is 0.02 to 0.4;

a mass ratio of HRE/(LRE+T) in the shell layer region T2 is greater than a mass ratio of HRE/(LRE+T) in the $R_2Fe_{14}B$ grain region T3; and a mass ratio of Al/(LRE+T) in the shell layer region T2 is greater than a mass ratio of Al/(LRE+T) in the $R_2Fe_{14}B$ grain region T3.

Further, in the sintered magnet, R is at least one rare earth element, and T is one or more metals containing Fe and/or FeCo.

According to another aspect of the present invention, a preparation method of the sintered magnet is provided. The preparation method includes:

preparing a sintered blank;

depositing an alloy film layer on a surface of the sintered blank; and acquiring the sintered magnet by performing heat treatment on the sintered blank deposited with the alloy film layer.

Further, said preparing the sintered blank includes:

acquiring an alloy by smelting a raw material, and preparing a quick-setting flake with a thickness of 0.25 μm to 0.35 μm for a sintered body by using the alloy, the raw materials including 24.6 wt % of Nd, 5.8 wt % of Pr, 1.1 wt % of Co, 0.15 wt % of Al, 0.10 wt % of Cu, 0.15 wt % of Zr, 0.83 wt % of B and the balance of Fe;

crushing the quick-setting flake into alloy powder;

acquiring a green body by shaping the alloy powder in a magnetic field; and acquiring the sintered blank by sintering and tempering the green body.

Further, said crushing the quick-setting flake into the alloy powder includes: performing hydrogen absorption on the quick-setting flake at room temperature, then performing dehydrogenation at 620° C. for 1.5 hours, and finally acquiring fine powder of 3.5 μm to 4.5 μm by grinding the resulted quick-setting flake in a nitrogen atmosphere.

Further, said depositing the alloy film layer on the surface of the sintered blank includes:

removing an oxide scale on the surface of the sintered blank, and drying the sintered blank; and placing a diffusion source including components of heavy rare earth HRE, Al and M on the surface of a blank magnet, wherein M is at least one of Ga, Cu and Zn, a mass ratio of M/Al is 2 to 3.

Further, HRE, Al and M film layers are deposited in any order.

Further, the diffusion source in use is in a state of: a molten alloy liquid of a diffusion source alloy, a rapid-quenching strip of the diffusion source alloy, a quick-setting sheet of the diffusion source alloy, a sheet of the diffusion source alloy, powder of the diffusion source alloy, diffusion source alloy slurry acquired by mixing the alloy powder of the diffusion source alloy with a solvent, or a film layer acquired by physical vapor deposition.

Further, said acquiring the sintered magnet by performing the heat treatment on the sintered blank deposited with the alloy film layer includes: performing diffusion treatment at 650° C. to 1000° C. for 1 h to 24 h, and tempering at 400° C. to 700° C. for 0.5 h to 10 h, wherein preferably, the heat treatment is performed under protection of vacuum or an inert gas.

The above technical solutions of the present invention have the following beneficial technical effects.

(1) In the present invention, by optimizing a preparation process and a microstructure of the traditional rare earth permanent magnet, diffusion efficiency of heavy rare earth in the magnet is improved, such that the coercivity of the magnet is greatly improved, and manufacturing cost is reduced.

(2) In the R-T-B sintered magnet provided by the present invention, Al and M are used to replace partial heavy rare earth elements, such that a content of the heavy rare earth elements is reduced. In a case of the lower content of the heavy rare earth elements, the R-T-B sintered magnet still has high coercivity and residual magnetic flux density at room temperature and still has high coercivity at a high temperature.

DETAILED DESCRIPTION

Figure 1:
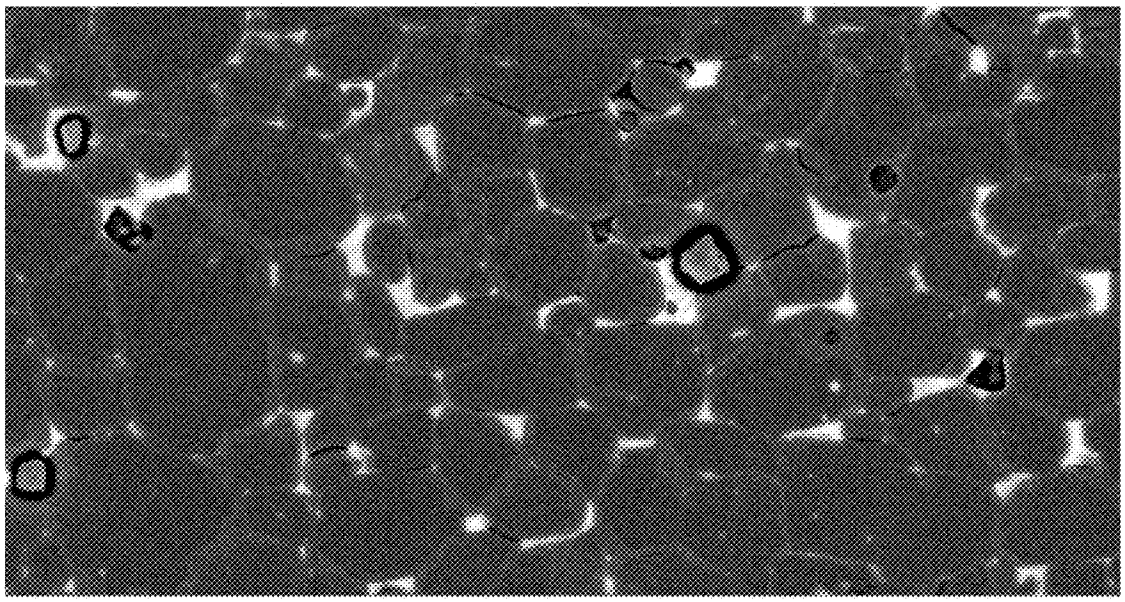
FIG. 1 is a scanning electron microscope photograph of a near-surface layer of an R-T-B sintered magnet.

In order to make the objectives, technical solutions and advantages of the present invention clearer, the present invention is further described in detail below with reference to the specific embodiments and accompanying drawings. It should be understood that these descriptions are merely exemplary and are not intended to limit the scope of the present invention. In addition, in the following description, descriptions of well-known structures and techniques are omitted to avoid unnecessary obscuring of the concepts of the present invention.

To enable those skilled in the art to better understand the technical solutions of the present invention, the technical solutions of the present invention are described clearly and completely below in conjunction with the accompanying drawings of the present invention. Other similar embodiments acquired by those of ordinary skill in the art based on embodiments of the present invention without creative labor shall fall within the protection scope of the present invention. In addition, the directional terms mentioned in the following embodiments, such as "upper", "lower", "left" and "right", only refer to the directions with reference to the accompanying drawings. Therefore, the used directional terms are used to illustrate but not limit the present invention. All features disclosed in the description or steps in all disclosed methods or processes, except mutually exclusive features and/or steps, may be combined in any way. Unless specifically stated, any feature disclosed in the description (including any additional claim, abstract and accompanying drawing) may be replaced with other equivalent or alternative features with similar purposes. That is, unless specifically stated, each feature is only one example of a series of equivalent or similar features.

In the present invention, by optimizing existing forms and contents of various elements in the magnet, consumption of heavy rare earth can be reduced while coercivity is unchanged.

I. Component

The sintered magnet provided by the present invention uses R-T-B as a main component. R is at least one rare earth element, R contains light rare earth LRE and heavy rare earth HRE, the LRE contains Pr and Nd, the HRE contains Tb and Dy, a content proportion of R is 29 wt. % to 33 wt. %, and a content proportion of the HRE is 0.05 wt. % to 1.5 wt. %. T is one or more transition metals containing Fe and/or FeCo, and contains Al and M, M is at least one of Ga, Cu and Zn, a proportion of Al is 0.22 wt. % to 0.35 wt. %, and a mass ratio of M/Al is 2 to 3. A content proportion of B is 0.82 wt. % to 0.95 wt. %.

According to the above composition, the content of B is less than that of B in a common R-T-B sintered magnet, the content of Al is greater than that of Al in the common R-T-B sintered magnet, and M is at least one of Ga, Cu and Zn. Thus, an R-M phase, represented by an $RM_2$ compound herein, is generated around a grain boundary region of $R_2Fe_{14}B$ grains due to M; and as the content of Al is high, an $R(M_{1-x}Al_x)_2$ compound is generated, and high $H_{cJ}$ may be achieved.

Each component is described in detail as follows.

R is at least one rare earth element, and a content of R is 29 wt. % to 33 wt. % (wt. % representing a mass ratio of the element). If R is less than 29 wt. %, it is difficult to avoid the existence of α-Fe phase and other impurity phases, resulting in difficulty in densifying during sintering. If the content of R exceeds 33 wt. %, a main phase proportion decreases, and thus a high remanence may not be realized. The content of R is preferably 29.6 wt. % to 32.2 wt. %; and within this range, an excellent magnetic property is guaranteed first.

In the present invention, R contains light rare earth LRE and heavy rare earth HRE, wherein the LRE contains Pr and Nd. More preferably, the LRE is Nd or PrNd or PrNdCe or PrNdLaCe. More preferably, in the case that the LRE contains La and/or Ce, a content thereof is less than 10 wt. %.

R contains the HRE which is necessary in the present invention, and a content proportion thereof is 0.05 wt. % to 1.5 wt. %. In the present invention, the heavy rare earth is necessary to improve the coercivity and the comprehensive magnetic property. Meanwhile, by controlling the content of each of B, M, Al and the like, the R-T-B sintered magnet with high $H_{cJ}$ can be acquired while reducing the content of the HRE. The content of the HRE is 0.05 wt. % to 1.5 wt. %. If the content of the HRE is less than 0.05 wt. %, the coercivity may not be improved obviously. If the content of the HRE is higher than 1.5 wt. %, the remanence is adversely affected, which is not conducive to the improvement of the comprehensive magnetic property.

In the present invention, T is one or more transition metals containing Fe and/or FeCo, and T contains Al and M, wherein M is at least one of Ga, Cu and Zn, the proportion of Al is 0.22 wt. % to 0.35 wt. %, and a mass ratio of M/Al is 2 to 3. $H_{cJ}$ may be increased through Al which is usually used as an inevitable impurity with a content of 0.05 wt % or more in a manufacturing process, and the total content of Al as the inevitable impurity and Al actively added may be equal to or greater than 0.22 wt % and less than or equal to 0.35 wt %. The content of M is 2 to 3 times of that of Al. If the content of M is less than this multiple, the excellent comprehensive magnetic property may not be acquired. If the content of M exceeds this multiple, the content of Fe and FeCo for providing the remanence decreases, which is not conducive to the improvement of the remanence.

T must contain Fe or FeCo. In the case that the material contains Co, a content of Co is less than 5 wt. %, and thus a corrosion resistance and the remanence may be improved by Co. But if a replacement amount of Co exceeds 5 wt. %, the property of the magnet is reduced.

In the rare earth magnet provided by the present invention, the rare earth, T, and B all contain inevitable impurities, and may also contain Cr, Mn, Si, Sm, Ca, Mg, etc. In addition, the inevitable impurities in the manufacturing process exemplarily include O (oxygen), N (nitrogen), and C (carbon).

In addition, the R-T-B sintered magnet provided by the present invention may contain one or more other elements (including elements actively added except the inevitable impurities). For example, such elements may contain a small amount (about 0.1 wt. % respectively) of Sn, Ti, Ge, Y, H, F, V, Ni, Hf, Ta, W, Nb, Zr, and the like. In addition, the elements listed above as the inevitable impurities may be actively added, and the total amount of these actively added elements does not exceed 1 wt. %.

The content proportion of B is 0.82 wt. % to 0.95 wt. %. In the present invention, B is an inevitable element for forming the $R_2T_{14}B$ main phase. In order to avoid generating an $R_2T_{17}$ phase as a soft magnetic phase and other impurity phases such as a boron-rich phase, the content proportion of B is 0.82 wt. % to 0.95 wt. %, and more preferably 0.82 wt. % to 0.93 wt. %.

II. Microstructure

Figure 2:
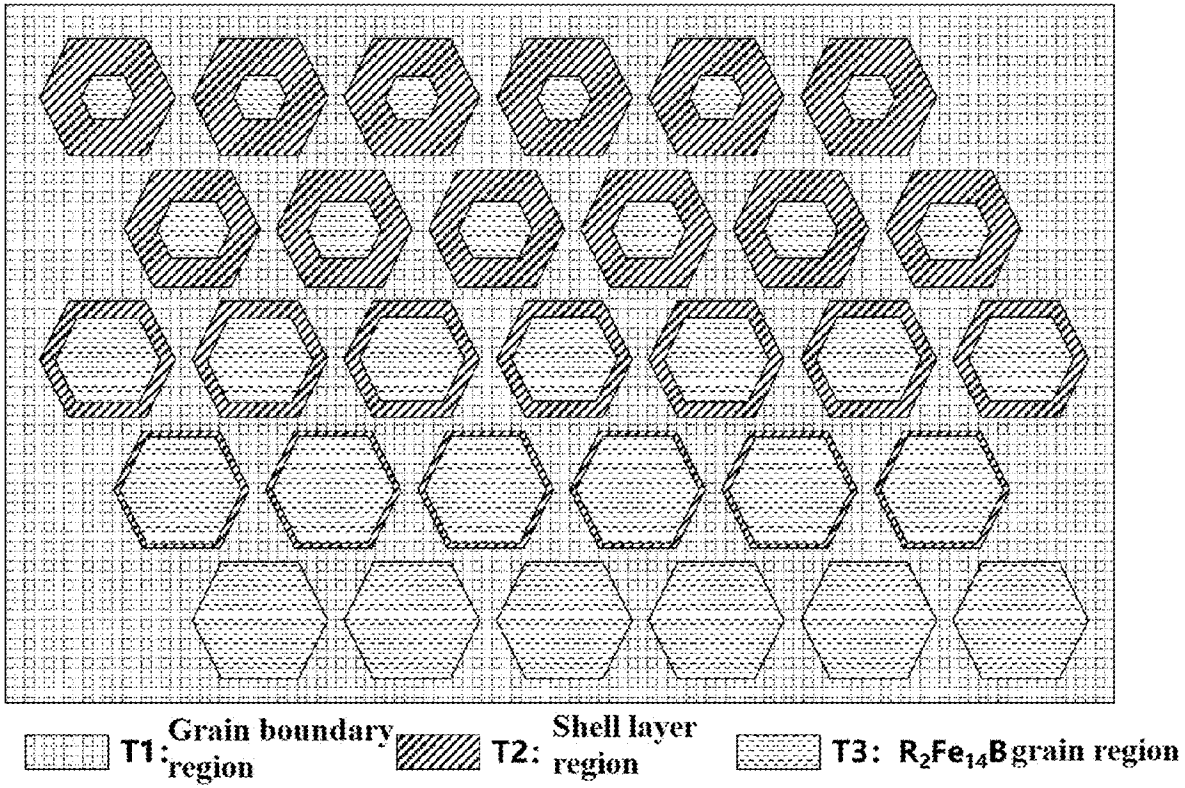
FIG. 2 is a schematic diagram of the near surface layer of the R-T-B sintered magnet.

In the present invention, the R-T-B sintered magnet consists of regions including T2. As shown in FIG. 2, T1 is a grain boundary region, T2 is a shell layer region, and T3 is a $R_2T_{14}B$ grain region. T1 and T3 regions are a grain boundary phase and a main phase of the sintered magnet respectively; and the contents, proportions and distribution of the T1 and T3 are keys to improve the comprehensive magnetic property of the sintered magnet. T2 is a key to enhance a magnetocrystalline anisotropy field of grains and improve the coercivity. The sintered magnet provided by the present invention has the following microstructure characteristics.

At 10 μm to 60 μm, preferably about 15 μm to about 40 μm, from a surface of the sintered magnet toward the center thereof, an area ratio of T2/T3 is 0.1 to 0.3, a thickness of T2 is 0.5 μm to 1.2 μm, and an average coating percent of T2 on T3 is 80% or more.

A mass ratio of (HRE+M+Al)/(LRE+Fe) in T2 is 0.02 to 0.4; a mass ratio of HRE/(LRE+T) in T2 is greater than a mass ratio of HRE(LRE+T) in T3; and a mass ratio of Al/(LRE+T) in T2 is averagely greater than a mass ratio of Al/(LRE+T) in T3.

A scanning electron microscope photograph of a near-surface layer of the R-T-B sintered magnet is as shown in FIG. 1.

III. Preparation Process

Figure 3:
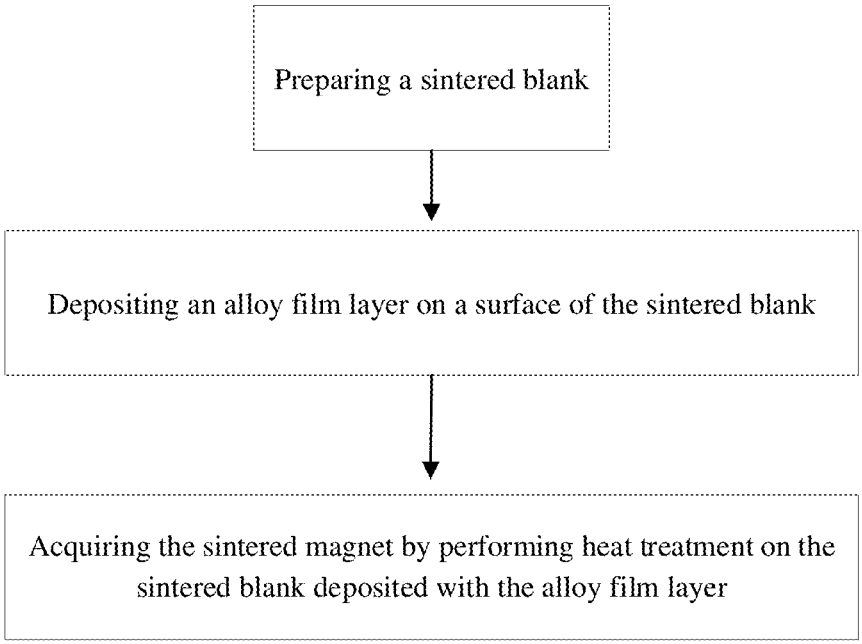
FIG. 3 is a flowchart of a preparation process of the sintered magnet.

Referring to FIG. 3, the preparation process of the present invention includes the following steps: preparing a sintered blank; depositing an alloy film layer on a surface of the sintered blank; and acquiring the sintered magnet by performing heat treatment on the sintered blank deposited with the alloy film layer.

1. Preparing the Sintered Blank

The sintered blank in the present invention is mainly prepared by a powder metallurgy method, and the preparation process includes processes of: preparing a quick-setting flake, crushing the quick-setting flake into alloy powder; shaping; and sintering and tempering. Each process is specifically described as follows.

(1) Preparing the Quick-Setting Flake

Raw materials including 24.6 wt % of Nd, 5.8 wt % of Pr, 1.1 wt % of Co, 0.15 wt % of Al, 0.10 wt % of Cu, 0.15 wt % of Zr, 0.83 wt % of B and the balance of Fe are smelted to acquire an alloy, and the quick-setting flake with a thickness of 0.25 μm to 0.35 μm is prepared by using the alloy, wherein the prepared alloy is manufactured into the quick-setting flake for the sintered body by thin-strip continuous casting (SC).

(2) Crushing the Quick-Setting Flake into the Alloy Powder

Hydrogen absorption is performed on the quick-setting flake at room temperature, and then dehydrogenation is performed at 620° C. for 1.5 hours, so as to achieve a purpose of coarse crushing of the quick-setting flake. Next, the processed quick-setting flake is ground into fine powder of 3.5 μm to 4.5 μm in a nitrogen atmosphere by using general air flow grinding technology.

(3) Shaping

In this process, the acquired alloy powder is shaped in a magnetic field to acquire the green body. Shaping in the magnetic field may be done by a method known to those skilled in the art, such as a dry shaping method in which dry alloy powder is inserted into a cavity of a mold and shaping is performed while applying the magnetic field, and a wet shaping method in which slurry with powder for sintering dispersed therein is injected into the cavity of the mold and shaping is performed while discharging a dispersed medium of the slurry.

(4) Sintering and Tempering

In this process, mainly, a compact magnet is acquired by sintering the green body acquired in the shaping process. The green body may be sintered by a method known to those skilled in the art. In addition, the sintering atmosphere in the present invention is preferably a vacuum atmosphere or an inert atmosphere. Tempering is performed after sintering, and the tempering temperature and tempering time may be known to those skilled in the art.

2. Depositing the Film Layer (1) An oxide scale on the surface of the sintered blank is removed, and drying is performed.

(2) A diffusion source including a component of heavy rare earth HRE is placed on the surface of the blank magnet.

Preferably, the diffusion source in use is in a state of: a molten alloy liquid of a diffusion source alloy, a rapid-quenching strip of the diffusion source alloy, a quick-setting sheet of the diffusion source alloy, a flake of the diffusion source alloy, powder of the diffusion source alloy, diffusion source alloy slurry acquired by mixing the alloy powder of the diffusion source alloy with a solvent, or a film layer acquired by physical vapor deposition.

Preferably, the diffusion source in use is in the state of the film layer acquired by the physical vapor deposition.

The diffusion source film layer is acquired preferably by magnetron sputtering technology in the physical vapor deposition.

Preferably, the diffusion source film layer is deposited on a surface of the blank magnet perpendicular to an orientation axis of the blank magnet.

A preferred manner for depositing the diffusion source film layer is: depositing an M film layer, an Al film layer and an HRE film layer sequentially in any order, depositing an Al-M dual alloy film layer and an HRE film layer sequentially in any order, and depositing an HRE-Al-M ternary alloy film layer.

A preferred manner for depositing the diffusion source film layer is: depositing the HRE-Al-M ternary alloy film layer.

3. Performing the Heat Treatment after Depositing the Film Layer

Preferably, the heat treatment in the present invention is performed under protection of vacuum or an inert gas; and the heat treatment process includes diffusion treatment at 650° C. to 1000° C. for 1 h to 24 h.

More preferably, the heat treatment in the present invention is performed under a certain vacuum condition; and the heat treatment process includes diffusion treatment at 650° C. to 1000° C. for 1 h to 24 h.

Further preferably, under a certain vacuum condition, the heat treatment process includes diffusion treatment at 650° C. to 1000° C. for 1 h to 24 h, and tempering at 400° C. to 700° C. for 0.5 h to 10 h.

EMBODIMENTS (1) A certain size of a sintered magnet blank is prepared, the height direction of the blank is the orientation direction thereof, and height data are detailed in Table 1. The surfaces of the blank magnet are cleaned, and it is ensured that the upper and lower surfaces of the blank magnet are smooth and flat.

(2) The surfaces of the blank magnet are cleaned, and it is ensured that the upper and lower surfaces of the blank magnet are smooth and flat. An HRE-Al-M ternary alloy film layer with a certain thickness is deposited in a sputtering manner on each of the upper and lower surfaces of the blank magnet perpendicular to the orientation axis of the blank magnet, wherein all of a coating amount, diffusion temperature and diffusion time of the HRE are detailed in Table 1.

(3) Diffusion and tempering are performed under a certain vacuum condition to acquire a high-coercivity sintered magnet. The tempering temperature and tempering time are detailed in Table 1.

The magnet required by the present invention is acquired after the tempering. At this time, residual diffusion source and oxide film layers exist on the surfaces of the sintered magnet. After the diffusion source and the oxide film layers are removed by a well-known method, the thickness of the magnet decreases by less than 10 μm.

Then, a microstructure of the magnet is scanned after the magnet is sliced along its height direction. The scanning may be performed by a field emission scanning electron microscope SEM. The magnet is observed from its infiltration surface to its center. A set observation range is above 80 μm (length)×40 μm (width); regions T1, T2 and T3 are calibrated; and an area, coating percent, thickness and atomic mass ratio of the T2 region at about 15 μm to about 40 μm from the magnet infiltration surface are calculated, and relevant data are listed in Table 2.

The area is calculated as follows. A backscattered electron image is binarized at a predetermined level; the T2 region and the T3 region are specified, areas of the T2 region and the T3 region at about 15 μm to about 40 μm from the magnet infiltration surface are calculated within the observation range above 80 μm (length)×40 μm (width), and a ratio of T2/T3 is acquired. A method for binarizing at the predetermined level to specify a main phase portion and a grain boundary portion is arbitrary as long as it is a commonly-used method.

The coating percent is calculated as follows. Within the observation range above 80 μm (length)×40 μm (width), the total length of all peripheral parts of T2 at about 15 μm to about 40 μm from the magnet infiltration surface and the total uncovered length of T3 are calculated, and the coating percent is calculated as a ratio of the total length of the peripheral parts of T2 to the sum of the length of the peripheral parts of T2 and the uncovered length of T3.

The thickness is calculated as follows. Within the observation range above 80 μm (length)×40 μm (width), a thickness of T2 on each $R_2Fe_{14}B$ at about 15 μm to about 40 μm from the magnet penetration surface is measured; measuring is performed for 3 times at different positions; all measured thicknesses and measurement times are counted; and finally, an average value is calculated.

The atomic mass ratio is calculated as follows. A WDS equipped for EPMA is used to scan a microscopic region at about 15 μm to 40 μm from the magnet penetration surface in an element surface scanning manner in the observation range above 80 μm (length)×40 μm (width); only the mass concentrations of HRE, LRE, M, Al and Fe are calibrated; and then, a mass ratio of (HRE+M+Al)/(LRE+Fe) is calculated.

The components and properties of the final magnet are listed in Table 3. It should be noted that each component is measured by high-frequency inductively coupled plasma-optical emission spectrometer (ICP-OES). A high-temperature permanent magnet measuring instrument NIM-500C is used to measure a residual magnetic flux density Br and coercivity HcJ.

Comparative Example 1

(1) A sintered magnet blank is prepared.

(2) The blank magnet is sliced into blocks with a certain size (length*width*height (orientation)).

(3) The surfaces of the blank magnet are cleaned, and it is ensured that the upper and lower surfaces of the blank magnet are smooth and flat.

(4) An HRE film layer with a certain thickness is deposited in a sputtering manner on each of the upper and lower surfaces perpendicular to the orientation axis of the blank magnet.

(5) A high-coercivity sintered magnet is acquired by performing diffusion and tempering under a certain vacuum condition.

The detection manner is the same as that in the above embodiment, and the data are shown in comparative examples 1-1 and 1-2.

Comparative Example 2

(1) The blank magnet is sliced into blocks with a certain size (length*width*height (orientation)).

(2) The surfaces of the blank magnet are cleaned, and it is ensured that the upper and lower surfaces of the blank magnet are smooth and flat.

(3) A high-coercivity sintered magnet is acquired by performing diffusion and tempering under a certain vacuum condition.

The detection manner is the same as that in the above embodiment, and the data are shown in comparative examples 2-1 and 2-2.

Referring to Tables 1, 2 and 3, sintered magnets in embodiments 1-1 to 1-8 are prepared by the method of the present invention, sintered magnets in comparative examples 1-1,1-2,2-1 and 2-2 are prepared by an existing method.

TABLE 1

| | Height of blank magnet for diffusion (mm) | Coating amount of HRE (wt. %) | Diffusion temperature (° C.) | Diffusion time (hr) | Tempering temperature (° C.) | Tempering time (hr) |
|---|---|---|---|---|---|---|
| Embodiment 1-1 | 5 | 0.20 | 880 | 8 | 500 | 5 |
| Embodiment 1-2 | 5 | 0.20 | 920 | 8 | 500 | 5 |
| Embodiment 1-3 | 5 | 0.25 | 880 | 8 | 500 | 5 |
| Embodiment 1-4 | 5 | 0.25 | 920 | 8 | 500 | 5 |
| Embodiment 1-5 | 5 | 0.30 | 880 | 8 | 500 | 5 |
| Embodiment 1-6 | 5 | 0.30 | 920 | 8 | 500 | 5 |
| Embodiment 1-7 | 5 | 0.35 | 880 | 8 | 500 | 5 |
| Embodiment 1-8 | 5 | 0.35 | 920 | 8 | 500 | 5 |
| Comparative example 1-1 | 5 | 0.20 | 880 | 8 | 500 | 5 |
| Comparative example 1-2 | 5 | 0.25 | 880 | 8 | 500 | 5 |
| Comparative example 2-1 | 5 | 0 | 920 | 8 | 500 | 5 |
| Comparative example 2-2 | 5 | 0 | 920 | 8 | 500 | 5 |

TABLE 2

| | At about 15 μm to about 40 μm from surface of sintered magnet toward the center thereof | | | |
|---|---|---|---|---|
| | Area ratio of T2/T3 | Thickness of T2 (μm) | Coating percent of T2/T3 (%) | Mass ratio of (HRE + M + Al)/(LRE + T) |
| Embodiment 1-1 | 0.11 | 0.51 | 81.5 | 0.11 |
| Embodiment 1-2 | 0.14 | 0.56 | 83.5 | 0.15 |
| Embodiment 1-3 | 0.16 | 0.62 | 85.4 | 0.19 |
| Embodiment 1-4 | 0.18 | 0.71 | 86.8 | 0.22 |
| Embodiment 1-5 | 0.20 | 0.78 | 87.6 | 0.26 |
| Embodiment 1-6 | 0.23 | 0.83 | 88.3 | 0.29 |
| Embodiment 1-7 | 0.26 | 0.95 | 89.6 | 0.33 |
| Embodiment 1-8 | 0.28 | 1.1 | 90.8 | 0.38 |
| Comparative example 1-1 | 0.08 | 0.32 | 55 | 0.07 |
| Comparative example 1-2 | 0.11 | 0.40 | 60 | 0.11 |
| Comparative example 2-1 | 0 | 0 | 0 | 0.02 |
| Comparative example 2-2 | 0 | 0 | 0 | 0.04 |

TABLE 3

| | Content of M (wt. %) | B (wt. %) | Al (wt. %) | $B_r$ (mT) | $H_{CJ}$ (kA/m) |
|---|---|---|---|---|---|
| Embodiment 1-1 | 0.65 | 0.83 | 0.26 | 1432 | 1751 |
| Embodiment 1-2 | 0.63 | 0.83 | 0.25 | 1435 | 1768 |
| Embodiment 1-3 | 0.70 | 0.84 | 0.28 | 1424 | 1912 |
| Embodiment 1-4 | 0.68 | 0.84 | 0.27 | 1420 | 1956 |
| Embodiment 1-5 | 0.75 | 0.85 | 0.30 | 1418 | 2070 |
| Embodiment 1-6 | 0.73 | 0.85 | 0.29 | 1415 | 2085 |
| Embodiment 1-7 | 0.80 | 0.86 | 0.32 | 1405 | 2155 |
| Embodiment 1-8 | 0.85 | 0.86 | 0.34 | 1400 | 2194 |
| Comparative example 1-1 | 0.32 | 0.83 | 0.06 | 1439 | 1615 |
| Comparative example 1-2 | 0.29 | 0.84 | 0.08 | 1438 | 1823 |
| Comparative example 2-1 | 0.28 | 0.85 | 0.07 | 1449 | 1456 |
| Comparative example 2-2 | 0.33 | 0.86 | 0.09 | 1446 | 1464 |

It can be seen from Embodiments 1-1 to 1-8 that the higher the diffusion temperature is, the lager the content of HRE is; Hcj gradually increases, Br hardly decreases; and Al, M and B fluctuate reasonably within a preferred range. Compared with the comparative examples, the coercivity of the HRE-Al-M diffusion magnet is obviously improved.

To sum up, the present invention relates to the R-T-B sintered magnet and the preparation method thereof. In the sintered magnet, R is at least one rare earth element, and T is one or more transition metals containing Fe and/or FeCo. R contains the light rare earth LRE and the heavy rare earth HRE. The LRE contains Pr and Nd, and the HRE contains Tb and Dy, the content proportion of R is 29 wt. % to 33 wt. %, and the content proportion of the HRE is 0.05 wt. % to 1.5 wt. %. T contains Al and M, the proportion of Al is 0.22 wt. % to 0.35 wt. %, M is at least one of Ga, Cu and Zn, and a mass ratio of M/Al is 2 to 3. The content proportion of B is 0.82 wt. % to 0.95 wt. %. The sintered magnet consists of the regions including T2, wherein T1 is the grain boundary region, T2 is the shell layer region, and T3 is the $R_2T_{14}B$ grain region. At about 15 μm to about 40 μm from the surface of the sintered magnet toward the center thereof, the area ratio of T2/T3 is 0.1 to 0.3, the thickness of T2 is 0.5 μm to 1.2 μm, and the average coating percent of T2 to T3 is 80% or more. In the present invention, by optimizing the preparation process and the microstructure of the traditional rare earth permanent magnet, the diffusion efficiency of the heavy rare earth in the magnet is improved, such that the coercivity of the magnet is greatly improved, and the manufacturing cost is reduced. The sintered magnet provided by the present invention can reduce the consumption of the heavy rare earth while achieving the same coercivity, and is suitable for industrial production.

It should be understood that the foregoing specific implementations of the present invention are only configured to exemplarily illustrate or explain the principle of the present invention, and do not constitute limitations to the present invention. Thus, any modification, equivalent replacement, improvement and the like made without departing from the spirit and scope of the present invention should be encompassed by the protection scope of the present invention. In addition, the appended claims of the present invention are intended to cover all changes and modifications that fall within the scope and boundary of the appended claims, or equivalent forms of such scope and boundary.

What is claimed is:

1. A R-T-B sintered magnet, comprising a grain boundary region T1, a shell layer region T2 and an $R_2Fe_{14}B$ grain region T3, and the shell layer region T2 is located at the junction of the grain boundary area T1 and the $R_2Fe_{14}B$ grain area T3, which covers the $R_2Fe_{14}B$ grain area T3 and has a predetermined thickness; wherein R contains light rare earth LRE and heavy rare earth HRE, and a content proportion of the HRE is 0.05 wt. % to 1.5 wt. %; and T contains Al and M, and a proportion of Al is 0.22 wt. % to 0.35 wt. %; and M is at least one of Ga, Cu and Zn, and a mass ratio of M/Al is 2 to 3; and at 10 μm to 60 μm from a surface of the sintered magnet toward a center thereof, an area ratio of the shell layer region T2 to the $R_2Fe_{14}B$ grain region T3 is 0.1 to 0.3, and a thickness of the shell layer region T2 is 0.5 μm to 1.2 μm; and an average coating percent of the shell layer region T2 on the $R_2Fe_{14}B$ grain region T3 is 80% or more; and a mass ratio of (HRE+M+Al)/(LRE+T) in the shell layer region T2 is 0.02 to 0.4;

a mass ratio of HRE/(LRE+T) in the shell layer region T2 is greater than a mass ratio of HRE/(LRE+T) in the $R_2Fe_{14}B$ grain region T3; and a mass ratio of Al/(LRE+T) in the shell layer region T2 is greater than a mass ratio of Al/(LRE+T) in the $R_2Fe_{14}B$ grain region T3.

2. The R-T-B sintered magnet according to claim 1, wherein the HRE contains Tb and Dy, a content proportion of R is 29 wt. % to 33 wt. %; and a content proportion of B is 0.82 wt. % to 0.95 wt. %.

3. A preparation method of the sintered magnet according to claim 2, comprising:

preparing a sintered blank;

depositing an alloy film layer on a surface of the sintered blank; and acquiring the sintered magnet by performing heat treatment on the sintered blank deposited with the alloy film layer.

4. The R-T-B sintered magnet according to claim 1, wherein in the sintered magnet, R is at least one rare earth element, and T is one or more non-rare earth metals containing Fe and/or FeCo.

5. A preparation method of the sintered magnet according to claim 4, comprising:

preparing a sintered blank;

depositing an alloy film layer on a surface of the sintered blank; and acquiring the sintered magnet by performing heat treatment on the sintered blank deposited with the alloy film layer.

6. A preparation method of the sintered magnet according to claim 1, comprising:

preparing a sintered blank;

depositing an alloy film layer on a surface of the sintered blank; and acquiring the sintered magnet by performing heat treatment on the sintered blank deposited with the alloy film layer.

7. The preparation method according to claim 6, wherein said preparing the sintered blank comprises:

acquiring an alloy by smelting a raw material, and preparing a flake with a thickness of 0.25 μm to 0.35 μm for a sintered body by using the alloy, the raw materials comprising 24.6 wt % of Nd, 5.8 wt % of Pr, 1.1 wt % of Co, 0.15 wt % of Al, 0.10 wt % of Cu, 0.15 wt % of Zr, 0.83 wt % of B and the balance of Fe;

crushing the flake into alloy powder;

acquiring a green body by shaping the alloy powder in a magnetic field; and acquiring the sintered blank by sintering and tempering the green body.

8. The preparation method according to claim 7, wherein said crushing the flake into the alloy powder comprises: performing hydrogen absorption on the flake at room temperature, then performing dehydrogenation at 620° C. for 1.5 hours, and finally acquiring fine powder of 3.5 μm to 4.5 μm by grinding the resulted flake in a nitrogen atmosphere.

9. The preparation method according to claim 6, wherein said depositing the alloy film layer on the surface of the sintered blank comprises:

removing an oxide scale on the surface of the sintered blank, and drying the sintered blank; and placing a diffusion source comprising components of heavy rare earth HRE, Al and M on the surface of the sintered blank, wherein M is at least one of Ga, Cu and Zn, and a mass ratio of M/Al is 2 to 3.

10. The preparation method according to claim 9, wherein the diffusion source in use is in a state of: a molten alloy liquid of a diffusion source alloy, a quenched strip of the diffusion source alloy, a sheet of the diffusion source alloy, powder of the diffusion source alloy, diffusion source alloy slurry acquired by mixing the alloy powder of the diffusion source alloy with a solvent, or a film layer acquired by physical vapor deposition.

11. The preparation method according to claim 6, wherein said acquiring the sintered magnet by performing the heat treatment on the sintered blank deposited with the alloy film layer comprises: performing diffusion treatment at 650° C. to 1000° C. for 1 h to 24 h, and tempering at 400° C. to 700° C. for 0.5 h to 10 h, wherein the heat treatment is performed under protection of vacuum or an inert gas.

* * * * *